United States Patent [19]

Hanson

[11] 4,424,105

[45] Jan. 3, 1984

[54] GAS GENERATOR WITH REGULATED CURRENT SOURCE

[75] Inventor: Robert M. Hanson, Phoenix, Ariz.

[73] Assignee: Henes Products Corp., Phoenix, Ariz.

[21] Appl. No.: 405,586

[22] Filed: Aug. 5, 1982

[51] Int. Cl.[3] ..... C25B 1/06; C25B 15/02; C25B 15/08; C25B 9/04

[52] U.S. Cl. ..... 204/228; 204/269; 204/270; 204/278

[58] Field of Search ..... 204/129, 268–270, 204/278, 228

[56] References Cited

U.S. PATENT DOCUMENTS

| | | | |
|---|---|---|---|
| 3,451,906 | 6/1969 | Weed | 204/82 |
| 3,518,180 | 6/1970 | Grotheer | 204/268 |
| 3,616,436 | 10/1971 | Haas | 204/229 |
| 3,692,661 | 9/1972 | Shockcor | 204/269 |
| 3,824,172 | 7/1974 | Hodges | 204/269 |
| 3,957,618 | 5/1976 | Spirig | 204/270 |
| 3,994,798 | 11/1976 | Westerlund | 204/268 |
| 4,113,601 | 9/1978 | Spirig | 204/270 X |
| 4,124,480 | 11/1978 | Stevenson | 204/268 |
| 4,184,931 | 1/1980 | Inoue | 204/129 |
| 4,339,324 | 7/1982 | Haas | 204/270 |
| 4,369,102 | 1/1983 | Galluzzo et al. | 204/228 |

*Primary Examiner*—Donald R. Valentine
*Attorney, Agent, or Firm*—Warren F. B. Lindsley

[57] ABSTRACT

An improved apparatus for gas generators producing oxygen and hydrogen or oxyhydrogen gas, the apparatus comprising a solid state current limiting circuit in combination with an assembly of electrolytic cells. The current-limiting circuit replaces the variable auto-transformer commonly heretofore employed for adjusting cell current and regulates cell current.

11 Claims, 7 Drawing Figures

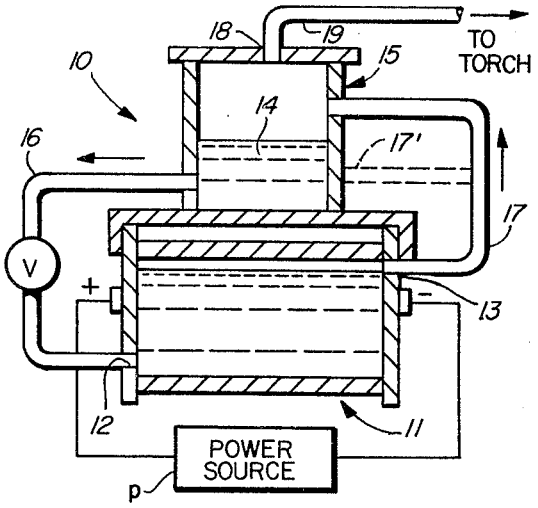
FIG. 1
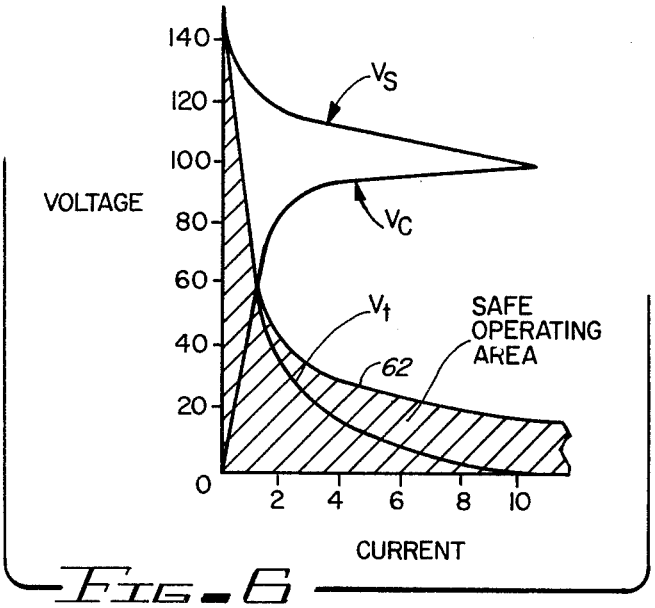
FIG. 6
FIG. 2
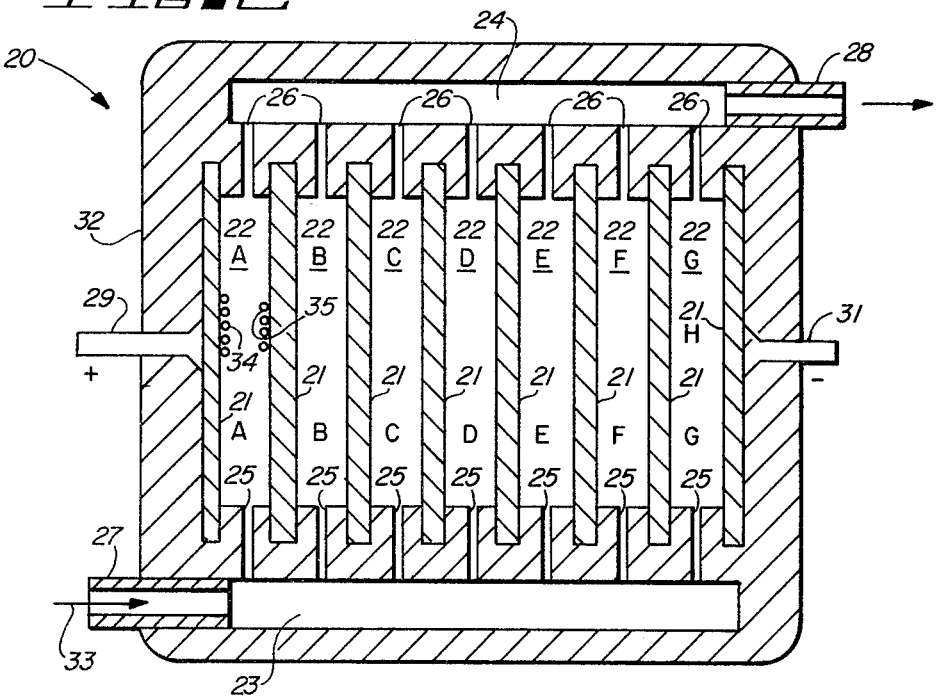
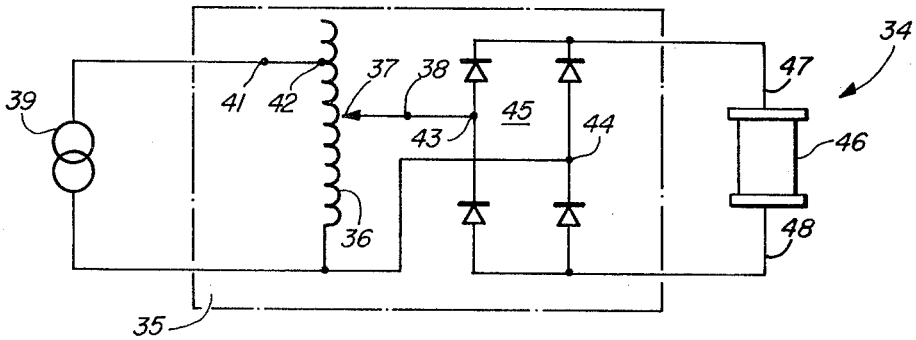
FIG. 3

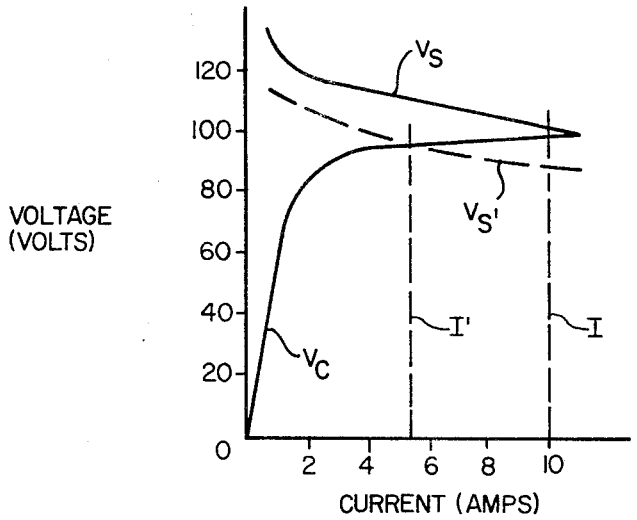
FIG. 4
FIG. 5
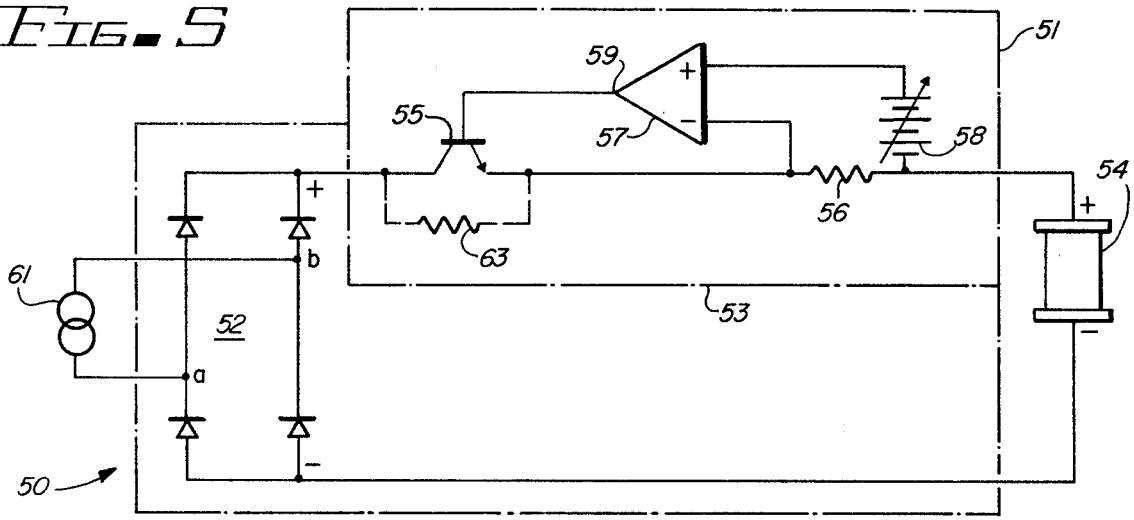
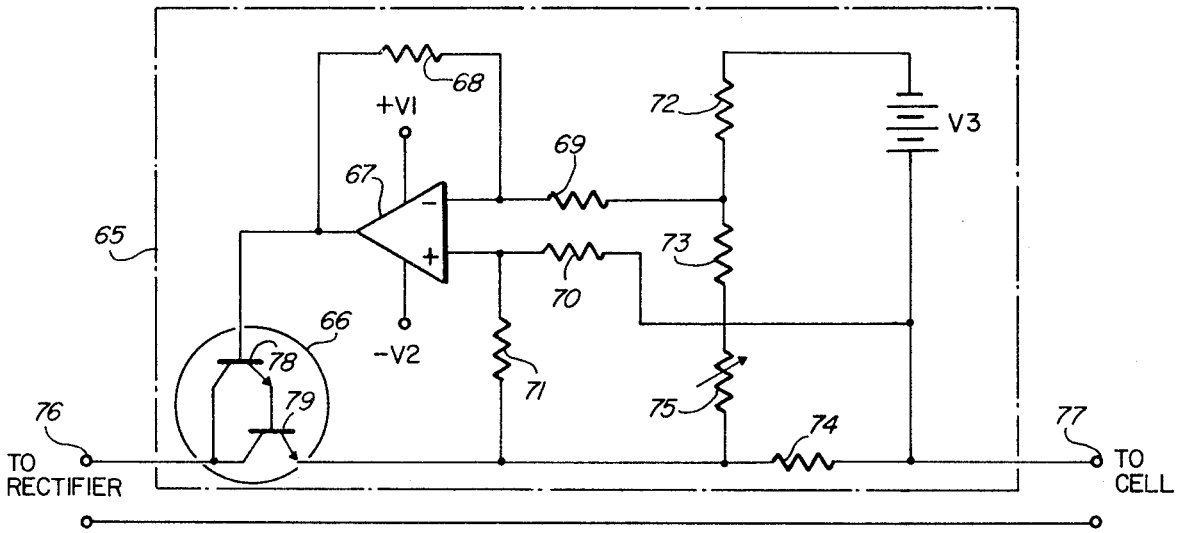
FIG. 7

GAS GENERATOR WITH REGULATED CURRENT SOURCE

BACKGROUND OF THE INVENTION

This invention relates to electrolysis and, more particularly, to the electrolysis of water for the generation of oxygen and hydrogen or a combination thereof which is commonly referred to as oxyhydrogen.

Electrolysis is a process in which an electric current is passed through a liquid causing a chemical reaction to take place. If the liquid is water, electrolysis "breaks up" the water into two gases, namely oxygen and hydrogen. In the electrolysis of water, the hydrogen gas collects at the cathode electrode and the oxygen gas collects at the anode electrode of the gas generator. Because pure water is not a suitable conductor of electricity, a conductor such as potassium hydroxide is added to the water to form an electrically conductive solution. Such a solution is known as an electrolyte. This process generates gas as a function of the surface area of the anode and cathode electrodes in contact with the electrolyte and directly proportional to the amount of current flowing through the gas generator.

One important practical use of the oxyhydrogen gas produced by this means is as a fuel for welding equipment. In this type of application, the proportions of oxygen and hydrogen produced by electrolysis (one part oxygen to two parts hydrogen) exactly matches the proportions needed for recombination (combustion) in the flame of an associated welding torch.

Oxygen is commonly administered to patients during surgical procedures or to patients suffering from respiratory problems.

Present day apparatus in use for generating oxygen and hydrogen or oxyhydrogen gas are generally very bulky and inefficient devices. The typical power employed in such devices contributes significantly to the total bulk and weight and does not provide the desired degree of control under conditions of varying line voltage.

More specifically, the power source is usually nothing more than a variable auto-transformer followed by a rectifier. The gas generator cells are connected across the d-c terminals of the rectifier, and cell current is adjusted by means of the variable autotransformer. Unfortunately, the volt-ampere characteristic of the cell is such that a small change in source voltage produces a relatively large change in cell current. Becuase line voltage is commonly characterized by frequent voltage dips and surges and by longer term variations in its steady-state value, such a power source is inadequate where a reasonably good degree of control is required over cell current and the rate of gas generation.

DESCRIPTION OF THE PRIOR ART

Although many patents have issued over the years directed to electrolysis equipment, none have developed an efficient, compact polycell gas generator; and, more particularly, none have provided a sufficient degree of control over cell current or the rate of gas generation.

U.S. Pat. No. 3,616,436 discloses a single pair of anode and cathode electrodes in a single electrolytic cell for the production of oxygen.

U.S. Pat. No. 3,451,906 discloses a multi-cell apparatus for the production of halates, perhalates or hypohalates of alkali metals. U.S. Pat. No. 3,518,180 describes a bipolar electrolytic cell and an assembly comprising a multiplicity of such cells for use in producing chlorates and perchlorates.

U.S. Pat. No. 3,692,661 describes an apparatus for removing pollutants and ions from liquids.

U.S. Pat. No. 3,824,172 describes an electrolytic cell for the production of alkali metal chlorates.

U.S. Pat. Nos. 3,957,618; 3,990,962; 4,014,777 and 4,206,029 describe further apparatus for the generation of detonating gas.

U.S. Pat. No. 3,994,798 describes an electrode assembly for use in multi-cell electrolysis apparatus.

U.S. Pat. No. 4,124,480 describes a bipolar cell for use primarily in the manufacture of sodium hypochlorite.

U.S. Patent Application, Ser. No. 212,274, now U.S. Pat. No. 4,339,324 entitled Polycell Gas Generator and filed Dec. 3, 1980 by Richard M. Haas and assigned to the assignee of this application discloses a gas generator comprising a multiplicity of electrolytic cells arranged to accommodate a series current path, parallel electrolytic flow and minimized leakage current paths, in a stacked plate configuration that affords a high degree of portabiity at low cost. This device does not, however, provide the desired improved control over cell current.

SUMMARY OF THE INVENTION

In accordance with the invention claimed, an improved gas generator is provided that incorporates a current regulator as a means for adjusting and controlling cell current. The characteristics of the main electronic element employed in the current regulator complements the volt-ampere characteristics of the gas generator cell in such a way that a uniquely wall matched combination results between the current source and the cell.

It is, therefore, one object of the present invention to provide an improved gas generator for producing oxygen and hydrogen or oxyhydrogen gas from water or for producing other types of gas using similar mechanical and electrical arrangements.

Another object of this invention is to provide in such as gas generator an improved degree of control over cell current, whereby the cell current and, hence, the rate of gas generation are not appreciably affected by variations in line voltage, cell temperature or other parameters.

A further object of the invention is to provide such an improved degree of control over cell current by taking advantage of the complementary relationship existing between the volt-ampere characteristic of the cell and a commercially available semiconductor device that is readily adaptable and ideally suited to this application.

A still further object of the invention is to provide a current source for a gas generator in a form that is less bulky, lighter in weight and less expensive to manufacture than the conventional variable voltage sources employed in prior art devices.

These and other objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 1 is a simplified functional diagram of a gas generator assembly;

FIG. 2 is a simplified functional diagram of the gas generator portion of the assembly of FIG. 1;

FIG. 3 is a simplified electrical diagram of the gas generator assembly of FIG. 1 incorporating a prior art power source;

FIG. 4 is a graphical illustration showing the volt-ampere characteristics of the gas generator of FIG. 1 in relationship with the volt-ampere characteristic of the conventional power source employed for prior art gas generators;

FIG. 5 is a simplified electrical diagram of a gas generator incorporating the improved power source of the invention;

FIG. 6 is a graphical illustration showing the volt-ampere characteristics of the gas generator in relationship with the characteristics of the improved power source of the invention; and FIG. 7 is a schematic diagram of the current limiting circuit comprising a key element of the improved power source of the invention.

DESCRIPTION OF THE PREFERRED EMBODIMENT

Referring more particularly to the drawings by characters of reference, FIG. 1 discloses a gas generator assembly 10 as an example of the general type of equipment to which the present invention is applicable. This assembly comprises an electrolysis chamber or generator 11 having inlet and outlet ports 12 and 13, respectively. Inlet port 12 is supplied with electrolyte 14 from a tank 15 mounted above chamber 11 through a pipe line 16 connected to tank 15 near its bottom. The outlet port 13 of chamber 11 is connected by means of a pipe line 17 to tank 15 at a suitable point in the tank. An outlet port 18 at the top of tank 15 is connected by means of a pipe line 19 to a suitable torch (not shown). Chamber 11 is electrically connected across a suitable source of power P as shown in FIG. 1.

FIG. 2 discloses a simplified diagram of an electrolysis chamber or polycell gas generator 20 functional in gas generator assembly 10 and comprising parallel, spaced apart, plate electrodes 21A–21H, electrolysis chambers 22A–22G, an electrolyte inlet manifold 23, a gas and electrolyte outlet manifold 24, inlet ports 25, outlet ports 26, an electrolyte supply port 27, a gas and electrolyte delivery port 28, a positive terminal 29 and a negative terminal 31. Generator 20 is enclosed in a sealed and electrically insulated housing 32 forming a cavity within which the chambers 22A–22G are formed.

The generator 20, as shown in FIG. 2, is employed in the electrolysis of water for the generation of oxyhydrogen gas. The electrolyte employed can be a solution of potassium hydroxide (KOH) and distilled water, the potassium hydroxide being employed to provide electrical conductivity. The electrodes 21A–21H are flat rectangular plates which may be made from nickel sheet stock.

In the operation of generator 20, electrolyte 33 enters port 27 and fills inlet manifold 23. From manifold 23, the electrolyte enters chambers 22A–22G via the inlet ports 25, filling chambers 22A–22G and then passes out through the outlet ports 26 into the manifold 24 from which it is finally exhausted through port 28. It will be immediately recognized that the chambers 22A–22G with their inlet ports 25 and their outlet ports 26 constitute parallel flow paths between the inlet manifold and the outlet manifold 24. The manifolds 23 and 24 are sufficiently large in cross-section to assure minimal pressure drops along their lengths. In addition, the entry port 27 is located at the bottom of generator 20, while the delivery port 28 is located at the top of generator 20 so that the total path length traversed by the electrolyte passing through any one of the several chambers 22A–22G is the same as that traversed by the electrolyte passing through any of the remaining chambers. These precautions help assure that the electrolyte is delivered to all the chambers at the same pressure and that the flow rate through all the chambers is the same.

Electric current flow is from the positive terminal 29 to electrode 21A, through the electrolyte in chamber 22A to electrode 21B, from electrode 21B through chamber 22B to electrode 21C, through chamber 22C to electrode 21D, through chamber 22D to electrode 21E, through chamber 22E to electrode 21F, through chamber 22F to electrode 21G, through chamber 22G to electrode 21H to negative terminal 31. The electrical conductivity of the electrodes 21A–21H is high, so that the potential difference between adjacent electrodes 21A and 21B, 21B and 21C, etc. is uniform over their mutually confronting surfaces. Current density from electrode to electrode through the intervening electrolyte is very uniform because the electrolyte is equally available to each electrode.

Within each of the chambers 22A–22G, current flows from the more positive electrode to the more negative electrode. Thus, the face of the plate electrode from which the current flows serves as the anode for that chamber while the face of the other juxtapositioned plate electrode to which the current flows becomes the cathode. It will be recognized that the opposite face of the electrode serving as a cathode for chamber 22A serves as the anode for chamber 22B. The electrode 21B and the electrodes 21C–21G are thus known as bipolar electrodes, each having one face employed as an anode and the opposite face as a cathode. Within each chamber, the current flowing from anode to cathode results in the generation of oxygen and hydrogen, the oxygen 24 collecting at the anode and the hydrogen 35 collecting at the cathode. Both the oxygen and the hydrogen are swept out of the chamber mainly by gravity, assisted by the electrolyte flowing through the chamber, the gas and electrolyte mixture passing through the outlet port 26 of each chamber into the outlet manifold 24 and thence through outlet port 28 to a collection chamber or tank (as shown in FIG. 1).

Because the electric current flows serially through the cells 22A–22G, a given source voltage may be approximately matched by an appropriate selection of the number of cells that are incorporated in the generator 20. In this way, it is possible in some cases to employ the rectified line voltage directly without the use of a step-down or a step-up transformer. Some means is needed, however, to adjust voltage across the generator or the current through the generator in order to achieve the desired rate of gas generation.

FIG. 3 shows a gas generator apparatus 34 incorporating a conventional variable-voltage power source 35 of the type that is commonly employed in prior art gas generators. The source 35 comprises a variable voltage autotransformer 36 having a movable tap 37 connected to a transformer output terminal 38. By moving the tap 37, any desired portion of the transformer voltage may be picked off so that the a-c voltage available at the output terminal 38 may be adjusted to any value between zero volts and the full transformer voltage. If a tapped transformer winding is employed, as shown in FIG. 3, whereby the a-c line voltage 39 is connected via the transformer input terminal 41 to the fixed tap 42, the total a-c voltage available at terminal 38 may exceed line voltage by an amount determined by the transformer design. The variable voltage from the autotransformer 36 is supplied to the a-c terminals 43 and 44 of a single-phase full-wave bridge rectifier 45, and the gas generator 46 is connected across the d-c terminals 47 and 48 of rectifier 45. Control of the rate of gas generated is effected through the adjustment of transformer 36 which controls the value of the voltage applied to the generator 46.

The shortcomings of the conventional source 35 are illustrated in FIG. 4. The curve identified as Vc shows the volt-ampere characteristic of the gas generator 46, and the curves Vs and Vs' show the volt-ampere characteristics of the source 35 with Vs being representative for nominal line voltage and Vs' showing the effect of a ten percent reduction in line voltage.

The generator or cell voltage Vc is seen to rise sharply as voltage increases from zero, until cell current reaches a value of approximately 2.0 amperes. At this point, the slope of the curve is reduced abruptly so that further small increases in cell voltage produce relatively large increases in cell current. It will be recognized, of course, that the voltage and current values will change as a function of the generator design, but the general shape of the curve Vc is representative of all electrolytic generators of this type.

As shown by the curve Vs, the voltage supplied by the source 35 falls off rather gradually as its load current increases. The result is a relatively flat volt-ampere characteristic for the source with a small negative slope.

For any given setting of the auto-transformer 36, a volt-ampere characteristic will result for the source 35. The characteristic for each setting will have the general shape of the curve Vs; it will lie above or below the curve Vs; and will run approximately parallel therewith. Exemplary of such other settings of the transformer 36 is the curve Vs' which corresponds to a ten percent reduction in source voltage.

The current supplied to the generator 46 for a given setting of the transformer 36 is determined by the intersection of the source characteristic Vs and the cell characteristic Vc. Thus, for the source characteristic Vs, a current I of approximately 10 amperes results as indicated by the intersection of curves Vs and Vc.

Unfortunately, line voltage is not stable at a given value but varies with time. A sudden application of a heavy load at another point on the same distribution network may produce an abrupt drop in line voltage. Line voltage dips of ten percent or more are common.

If the transformer 36 of FIG. 3 is initially set to produce a generator current of 10 amperes, as results from the characteristic Vs, and if, subsequently to such a setting a ten percent line voltage drop occurs, the operation of the source 35 will shift to the characteristic Vs' which intersects the generator characteristic Vc at a current of approximately five amperes. It is thus seen that a line voltage shift of only ten percent can readily produce a much larger change in cell current. This is, of course, a very undesirable feature of the prior art gas generator.

In the improved gas generator apparatus 50 of the invention, as shown in the simplified electrical diagram of FIG. 5, the power source 51 comprises a single-phase full-wave bridge rectifier 52 and a current-limiter 53. The current-limiter 53 is connected in series with the gas generator 54 across the d-c terminals + and − of the rectifier 52.

The current-limiter 53 comprises an NPN transistor 55, a sensing resistor 56, an error amplifier 57 and a reference voltage supply 58. The collector of transistor 55 is connected to the positive terminal + of rectifier 52. The emitter of transistor 55 is connected through sensing resistor 56 to the positive input terminal of the gas generator 54, and the negative terminal of generator 54 is connected to the negative terminal of rectifier 52. Amplifier 57 has its inverting input terminal (−) connected to the junction of resistor 56 and the emitter of transistor 55; it has its non-inverting input terminal (+) connected through voltage supply 58 to the junction of resistor 56 and the positive terminal of generator 54; and it has its output terminal 59 connected to the base of transistor 55. The a-c terminals a and b of rectifier 52 are connected directly to line voltage source 61.

In the operation of the current-limiter 53, reference supply 58 supplies base drive current to amplifier 57 so that transistor 55 is rendered conductive. A d-c current thus flows from the positive d-c terminal of rectifier 52, through transistor 55 from collector to emitter, through resistor 56 and through gas generator 54 to the negative terminal of rectifier 52. The collector-to-emitter effective resistance of transistor 55 is low for values of emitter current flowing through resistor 56 which do not produce across resistor 56 a voltage in excess of the voltage supplied by reference supply 58. As emitter current increases and the resulting voltage drop across resistor 56 approaches the value of the reference voltage, the inverting input terminal (−) of amplifier 57 approaches the reference voltage applied to the non-inverting input terminal (+), so that the amplifier output voltage begins to fall and the base drive current to transistor 55 begins to be diminished. The effective resistance of transistor 55 thus increased to limit any further rise in current. The power source 51 thus constitutes a constant current source for which the value of current supplied is equal to the reference voltage divided by the value of the resistor 56. If, for example, the reference voltage is set at one volt and resistor 56 is 0.1 ohms, the current will be limited to 10 amperes; if the reference voltage is reduced to 0.5 volts, the current will be limited to 5 amperes.

The compatibility of a gas generator with a power transistor connected as a current source is illustrated by FIG. 6. In FIG. 6, the volt-ampere characteristic of the voltage source at the d-c terminals of rectifier 52 is given by the curve Vs and the characteristic of the generator 54 is given by the curve Vc. The difference between Vs and Vc at any given value of current is equal to the voltage across transistor 55, neglecting the small voltage drop across resistor 56. The point-by-point subtraction of Vc from Vs thus yields the curve Vt which represents transistor voltage as a function of current. Associated with any particular power transistor is a safe operating area. The transistor must be operated within this area to prevent its destruction due to excessive internal heating. The safe operating area for the particular transistor employed in a first implementation of the invention is shown by the shaded area of FIG. 6. It will be noted that for all values of current from zero to 10 amperes, the operation of the transistor, as represented by the curve Vt, lies within the safe operating area. More particularly, it will be noted that the shape of the curve Vt approximates the shape of the upper boundary 62 of the safe operating area, so that in application of the device, the safe operating area appears almost to be tailored to meet the needs of the application.

The only region of operation in which the transistor is operated near the limiting boundary of the safe operating area is at relatively low currents where the voltage across the transistor is high. To alleviate this condition, a collector-to-emitter resistor 63 may be connected as shown in FIG. 5. The transistor current will then be diminished by the amount of the current drawn by resistor 63 at any given value of collector-emitter voltage and the operation of the transistor will thus be shifted to a condition of reduced thermal dissipation.

A more detailed illustration of the current-limiter employed in the first embodiment of the invention is shown in FIG. 7. The current-limiter 65 of FIG. 7 comprises a Darlington transistor 66, an error amplifier 67, fixed resistor 68-74, a variable resistor 75, a reference supply V3 and auxiliary voltage sources V1 and V2. The current-limiter has an input terminal 76 and an output terminal 77 which are intended to be connected, respectively, to the positive d-c terminal of the bridge rectifier and the positive input terminal of the gas generator.

The Darlington transistor is a widely used combination of two NPN transistors having their collectors connected together. The emitter of one transistor is connected to the base of the other. The two transistors connected in this fashion function approximately as a single transistor, but they exhibit a gain that approximates the product of the individual gains of the two devices. A considerably lower value of drive current is thus required. As shown in FIG. 7, the Darlington transistor 66 comprises an input transistor 78 and an output transistor 79. The emitter of transistor 78 is connected internally to the base of transistor 79. The common collectors of transistors 78 and 79 comprise the collector of Darlington transistor 66; the base of transistor 78 serves as the base of the Darlington transistor; and the emitter of transistor 79 serves as the emitter of the Darlington transistor.

Error amplifier 67 has its output connected directly to the base of transistor 66. Its positive and negative source terminals are connected, respectively, to voltage sources V1 and V2. Source V1 supplies +9 volts and source V2 supplies −9 volts as referenced to output terminal 77. Resistor 74 is the current sensing resistor and is connected between the emitter of transistor 66 and output terminal 77. Reference supply V3 has its positive terminal connected to terminal 77; its negative terminal is connected through serially connected resistors 72, 73 and 75 to the junction of resistor 74 and the emitter of transistor 66. The inverting input terminal (−) of amplifier 67 is connected through resistor 69 to the junction between resistors 72 and 73, and the non-inverting input terminal (+) is connected to output terminal 77 through resistor 70. Resistor 68 is connected as a feedback resistor from the inverting input terminal to the output terminal of amplifier 67, and resistor 71 is connected from the non-inverting input terminal to the emitter of transistor 66. In the first implementation of the invention, the transistor 66 was a Motorola MJ11014 Darlington and the error amplifier 67 was a Motorola MC1741. The value of the sensing resistor 74 was 0.05 ohms. Resistance values of resistors 72, 73 and 74 were 470 ohms, 10 ohms and 100 ohms, respectively, and reference supply V3 was 5 volts. The voltage at the junction of resistors 72 and 73 (with no current from other sources flowing through sensing resistor 74) is adjustable between zero and approximately one volt negative relative to output terminal 77. With no current supplied from output terminal 77, the inverting input terminal of amplifier 67 is thus set at a negative value and the non-inverting input terminal is at zero volts which is positive relative to the inverting input terminal. The output terminal of amplifier 67 is positive or high and it supplies a positive base driven current to transistor 66.

When a positive source voltage is applied at input terminal 76, a current is produced, flowing through transistor 66 and resistor 74 to the gas generator connected at output terminal 77. This current rises to a value at which the positive voltage drop developed across sensing resistor 74 is equal to the set value of negative reference voltage originally applied to the inverting input terminal of amplifier 67. It will be recognized that the voltage applied to the inverting input terminal is the sum of the set value of negative reference voltage and the positive sensing voltage. Thus, as these two voltages approach cancellation, the voltage applied to the inverting input terminal approaches zero volts heading toward a positive value with respect to the non-inverting input terminal which is at zero volts. Base drive to transistor 66 thus begins to diminish as voltage cancellation is approached, and the current limiting action is thereby initiated.

Resistor 68 is connected as a feedback resistor to limit the gain of amplifier 67 and to enhance stability. Resistor 71 also enhances stability and reduces sensitivity to electrical noise.

With sufficient voltage supplied from the line through a bridge rectifier, the circuit of FIG. 7 supplies a constant controlled current to a connected gas generator. The current is adjustable by means of resistor 75 to any desired value between zero and 10 amperes and it remains fixed independent of variations in the source voltage supplied from the rectifier.

Because no fixed or adjustable input transformer is required, the entire gas generator apparatus is considerably lighter and smaller than the prior art equivalent apparatus.

A ripple filter consisting of a capacitor or suitable inductor capacitor may be included after the rectifier to reduce heating effects of ripple current and to lower the voltage withstanding requirements for the transistor. The described current regulator will further reduce this ripple current.

An improved gas generator is thus provided in accordance with the stated objects of the invention and although but a single embodiment of the invention has been illustrated and described, it will be apparent to those skilled in the art that various changes and modifications may be made therein without departing from the spirit of the invention or from the scope of the appended claims.

What is claimed is:

1. A multi-cell gas generator assembly comprising in combination:

a housing defining a cavity, a plurality of chambers within the cavity of said housing, each chamber defining a gas generating cell, adjacent chambers being separated by electrode plates, each chamber having inlet and outlet ports, a gas and electrolyte separating tank means for receiving an electrolyte and comprising inlet and first and second outlet port means, said first outlet port means of said tank means being connected to said inlet ports of said chamber and said outlet ports of said chambers being connected to said first inlet port means of said tank means, said second outlet port means of said tank means being positioned above the surface of electrolyte placed in said tank means for discharging gas generated from said tank means, and means for connecting a variable voltage power source to electrical terminals across said chambers to achieve the desired rate of gas generation in said chambers, said means comprising a current regulator incorporating a series transistor operated in a variable-resistance, current-limiting mode.

2. The multi-cell gas generator assembly set forth in claim wherein:

said current regulator comprises means for adjusting and controlling cell current.

3. The multi-cell gas generator set forth in claim 1 wherein:

said current regulator includes a transistor connected in series with said chambers across the d-c terminals of said rectifier.

4. The multi-cell gas generator set forth in claim 1 wherein:

said means comprises a d-c power source with positive and negative terminals connected in series with the current regulator and cells of said chamber.

5. The multi-cell gas generator set forth in claim 1 wherein:

said variable voltage power source comprises one of the energy sources comprising a battery, d-c generator, and alternating current source with suitable rectifier and ripple filter, and with positive and negative terminals connected in series with the current regulator and cells of said chamber.

6. A multi-cell gas generator assembly comprising in combination:

a housing defining a cavity, a plurality of chambers within the cavity of said housing, each chamber defining a gas generating cell, adjacent chambers being separated by electrode plates, each chamber having inlet and outlet ports, a gas and electrolyte separating tank means for receiving an electrolyte and comprising inlet and first and second outlet port means, said first outlet port means of said tank means being connected to said inlet ports of said chamber and said outlet ports of said chambers being connected to said first inlet port means of said tank means, said second outlet port means of said tank means being positioned above the surface of electrolyte placed in said tank means for discharging gas generated from said tank means, means for connecting a variable voltage power source to electrical terminals across said chambers to achieve the desired rate of gas generation in said chambers, said means comprising a current regulator, said means including a rectifier having positive and negative terminals connected in series with a current limiter across the cells of said chamber, and a ripple filter consisting of a capacitor or inductor-capacitor connected across positive and negative terminals of the rectifier.

7. A multi-cell gas generator assembly comprising in combination:

a housing defining a cavity, a plurality of chambers within the cavity of said housing, each chamber defining a gas generating cell, adjacent chambers being separated by electrode plates, each chamber having inlet and outlet ports, a gas and electrolyte separating tank means for receiving an electrolyte and comprising inlet and first and second outlet port means, said first outlet port means of said tank means being connected to said inlet ports of said chamber and said outlet ports of said chambers being connected to said first inlet port means of said tank means, said second outlet port means of said tank means being positioned above the surface of electrolyte placed in said tank means for discharging gas generated from said tank means, and means for connecting a variable voltage power source to electrical terminals across said chambers to achieve the desired rate of gas generation in said chambers, said means comprising a current regulator, said means including a rectifier having positive and negative terminals connected in series with a current limiter across the cells of said chamber, said current limiter comprises a transistor comprising emitter, collector and base terminals; a sensing resistor; an error amplifier having two input terminals and an output terminal and a reference voltage source, said collector terminal of said transistor being connected to the positive terminal of said rectifier, said emitter terminal being connected in series with said sensing resistor to one of said terminals of said chambers and the other of said terminals of said chambers being connected to the negative terminal of said rectifier, said amplifier having one of its input terminals connected to the junction of said sensing resistor and the emitter terminal of said transistor and its other input terminal connected through said voltage source to the junction of said sensing resistor and said one of said terminals of said chambers and its output terminal to the base terminal of said transistor.

8. The multi-cell gas generator set forth in claim 7 wherein:

the current supplied to said chamber is equal to the voltage of said reference voltage source divided by the resistance value of said sensing resistor.

9. The multi-cell gas generator set forth in claim 7 wherein:

said transistor comprises an NPN transistor.

10. The multi-cell gas generator set forth in claim 7 wherein:

a ripple filter consisting of a capacitor or inductor-capacitor is connected across positive and negative terminals of the rectifier.

11. The multi-cell gas generator set forth in claim 7 wherein:

the reference voltage control is provided with a calibrated dial and shaft pointer to allow presetting the desired current and resulting gas production volume to the desired value.

* * * * *

UNITED STATES PATENT OFFICE

CERTIFICATE OF CORRECTION

Patent No. 4,424,105 Dated January 3, 1984

Inventor(s) Robert M. Hanson

It is certified that error appears in the above-identified patent and that said Letters Patent are hereby corrected as shown below:

Claim 2, line 2, after "claim" insert ---1---.

Signed and Sealed this

*Sixth* Day of *March 1984*

[SEAL]

*Attest:*

GERALD J. MOSSINGHOFF

*Attesting Officer*

*Commissioner of Patents and Trademarks*